US005488990A

United States Patent [19]

Wadleigh et al.

[11] Patent Number: 5,488,990

[45] Date of Patent: Feb. 6, 1996

[54] APPARATUS AND METHOD FOR GENERATING INERT GAS AND HEATING INJECTED GAS

[75] Inventors: Eugene E. Wadleigh; Albert C. Compton; David E. Ellwood, all of Midland, Tex.

[73] Assignee: Marathon Oil Company, Findlay, Ohio

[21] Appl. No.: 308,021

[22] Filed: Sep. 16, 1994

[51] Int. Cl.[6] ..... E21B 36/02

[52] U.S. Cl. ..... 166/260; 166/59

[58] Field of Search ..... 166/53, 57, 59, 166/260, 302, 303

[56] References Cited

U.S. PATENT DOCUMENTS

| | | | |
|---|---|---|---|
| 4,137,968 | 2/1979 | Howard et al. | 166/53 |
| 4,205,725 | 6/1980 | Howard et al. | 166/315 |
| 4,380,265 | 4/1983 | Mohaupt | 166/303 X |
| 4,454,915 | 6/1984 | York et al. | 166/260 X |
| 4,945,984 | 8/1990 | Price | 166/260 X |
| 5,255,742 | 10/1993 | Mikus | 166/303 |

FOREIGN PATENT DOCUMENTS

| | | | |
|---|---|---|---|
| 1250225 | 2/1989 | Canada | 166/38 |

*Primary Examiner*—Michael Powell Buiz
*Attorney, Agent, or Firm*—Jack L. Hummel; Jack E. Ebel

[57] ABSTRACT

A downhole burner that economically generates hot inert gas and injects this gas into a subterranean formation. The burner has a nipple attached to a first tubing string that carries an oxidizer to the burner. The first tubing string also contains a coil tubing string that carries fuel to a movable nozzle inside the nipple. A small orifice in the nozzle increases the velocity of the fuel, and the nozzle extends out through a small orifice in a burner shroud that increases the velocity of the oxidizer flowing around the nozzle. The high velocity of the fuel and oxidizer keeps the flame front below the shroud and nozzle. A second tubing string supplies coolant gas around the burner shroud. Injection of an oxygen containing coolant gas provides a method for enhancing in situ combustion reactions through superheating the oxygen containing mix of coolant and exhaust gas.

27 Claims, 6 Drawing Sheets

APPARATUS AND METHOD FOR GENERATING INERT GAS AND HEATING INJECTED GAS

TECHNICAL FIELD

This invention relates generally to enhanced oil recovery, and in particular to an apparatus and methods for simultaneously maintaining pressure in and heating a subterranean formation.

BACKGROUND OF THE INVENTION

It is a common oilfield practice to inject gas into an oil reservoir for pressure maintenance. Relatively inexpensive gas may be added to a reservoir at sufficient rates to increase reservoir pressure resulting in an increased oil production rate while reducing or eliminating aquifer influx and associated water production. Accomplishing a significant pressure increase requires that a large, cost effective, source of inert gas be available. Surface generation of low pressure flue gas has been employed by industry as a source of inert gas, however, it is expensive to treat the flue gas in order to remove acids in the gas prior to compressing the gas for injection into the reservoir. These costs can be avoided by generating the gas under pressure.

Under some circumstances, it is desirable to heat the injected gas. For example, heat has been used to increase the mobility of the oil by decreasing the viscosity of the oil in the formation, increasing the volume of the oil, or increasing the rate of imbibition of flooding fluids. Steam or an oxidizing gas is often injected into formations bearing highly viscous oil. The oxidizing gas can be used to burn some of the oil in situ, thereby providing an additional heat source. However, in other applications, such as when the oil is not highly viscous, heat and pressure may be applied to the formation by injecting heated gas, such as nitrogen, carbon dioxide, or recycled produced gas.

If the gas for injection is heated at the surface, considerable heat is lost as the gas flows through the flowline, well tubing and casing, and into the formation. Thus, it is more efficient to heat the gas inside the well, adjacent to the formation into which the gas is to be injected.

If the reservoir to be heated has been under production for a considerable length of time, it may also be more economic to convert existing producer wells to injector wells. Significant costs can also be avoided by using existing surface and downhole hardware in the converted wells. However, prior art downhole burners require the use of specially fabricated wellhead hardware, downhole hardware, and a specially completed well, and cannot be easily used in already-completed wells.

Prior art burners have not been designed for prolonged operation or to provide the combined benefit of inert gas generation and superheating of the injected oxygen containing gas stream. Injected gas is often cool, resulting in low reactivity and less efficient reaction of the oxygen. Superheated gas injection assures maintenance of a hot reactive system from the burner out to the unaffected liquid hydrocarbon containing formation.

Prior art burners have traditionally used electrical igniters to start combustion within the well, which requires that electrical wires be run alongside the fuel gas and oxidizer tubing down to the burner, thus requiring that the wires penetrate any packer device used to prevent reservoir fluids from flowing back up the well. These electrical wires are a source of leakage of the packer device.

Another disadvantage of prior art burners is that they lack the plug profile necessary to use wireline retrievable plugs. The use of wireline retrievable plugs provides the opportunity for the burner to be inserted (commonly called snubbing) into the well without "killing" the well, thus saving cost, and damage to the formation containing the well, as well as providing a safer environment for the well operators as the burner is being inserted into and removed from the well. This also facilitates repair of the burner nozzle separate from repair of the shroud.

Still another limitation of prior art burners is that the entire burner, including the concentric or parallel fuel and air conduits must be inserted at the same time, since the burner must be assembled at the surface.

Thus, there is a need for a burner to generate inert gas for injection into oil reservoirs. There is also a need to heat the injected gas utilizing existing and conventional well casing, wellhead, and downhole hardware with such a burner. A further need is for a burner that does not require electrical ignition, and for a burner that can be inserted into a well without killing the well. The present invention meets these and other needs in the art.

DISCLOSURE OF INVENTION

It is an aspect of the present invention to provide a burner that supplies an economical source of hot inert gas and heated recycled gas to a subterranean formation.

Another aspect of the present invention is to provide such a burner that supplies hot inert gas for injection into a subterranean formation while using standard wellhead and downhole hardware.

Yet another aspect is to provide a burner that resides inside the well and can be ignited using pyrophoric means.

Still another aspect is to provide a burner that can be inserted into a well with existing bottomhole pressure using wireline retrievable plugs.

A further aspect is that the burner may be operated to provide a superheated oxygen-rich gas for enhancement of in situ combustion processes.

A still further aspect is to provide a burner wherein the combustion chamber and burner nozzle are not attached, but can be inserted separately into the well.

The above and other aspects of the invention are accomplished in a downhole burner for generating hot inert gas for injection into a subterranean formation. A well penetrates and is in fluid communication with a subterranean formation. The upper portion of the well has a well casing, and the portion of the well within the subterranean formation allows fluid communication between the well and the formation. Within the casing are two tubing strings, a first for carrying a fuel and an oxidizing agent to the downhole burner, and a second for carrying coolant gas, such as recycled produced gas, air when the process is in situ, or other available gas, into the well.

The burner has a nipple attached to the downhole end of the first tubing string, and the nipple has an inside profile to accept a wireline retrievable plug that allows the tubing and nipple assembly to be inserted into the well without killing the well. A nozzle resides inside the nipple, but is not attached to the nipple, thus it can be inserted into the well separately from inserting the nipple. The nozzle is attached to the downhole end of a coil tubing string that supplies fuel to the nozzle, and the nozzle has a small orifice in an elongated downhole end to increase the velocity of the fuel as it leaves the nozzle. The nozzle end extends out through a burner shroud and through a small orifice in the burner shroud that increases the velocity of the oxidizer flowing around the nozzle. The high velocity of both the fuel and oxidizer keep the flame front below the shroud and nozzle.

Another characterization of the present invention comprises a method for maintaining pressure in and heating a subterranean formation. Fuel a pyrophoric fluid, and an oxidizing gas are supplied to a downhole burner assembly. The fuel is ignited by the pyrophoric fluid and combusted with the oxidizing gas in the burner assembly. Recycled produced or inert coolant gas flows around the burner assembly inside the casing liner, providing cooling for the burner assembly and the combustion products. The combustion products are mixed with the coolant gas, and the heated gas mixture is injected into the subterranean formation.

DESCRIPTION OF THE DRAWINGS

The above and other aspects, features, and advantages of the invention will be better understood by reading the following more particular description of the invention, presented in conjunction with the following drawings, wherein.

BEST MODE FOR CARRYING OUT THE INVENTION

The following description is of the best presently contemplated mode of carrying out the present invention. This description is not to be taken in a limiting sense but is made merely for the purpose of describing the general principles of the invention. The scope of the invention should be determined by referencing the appended claims.

Figure 1:
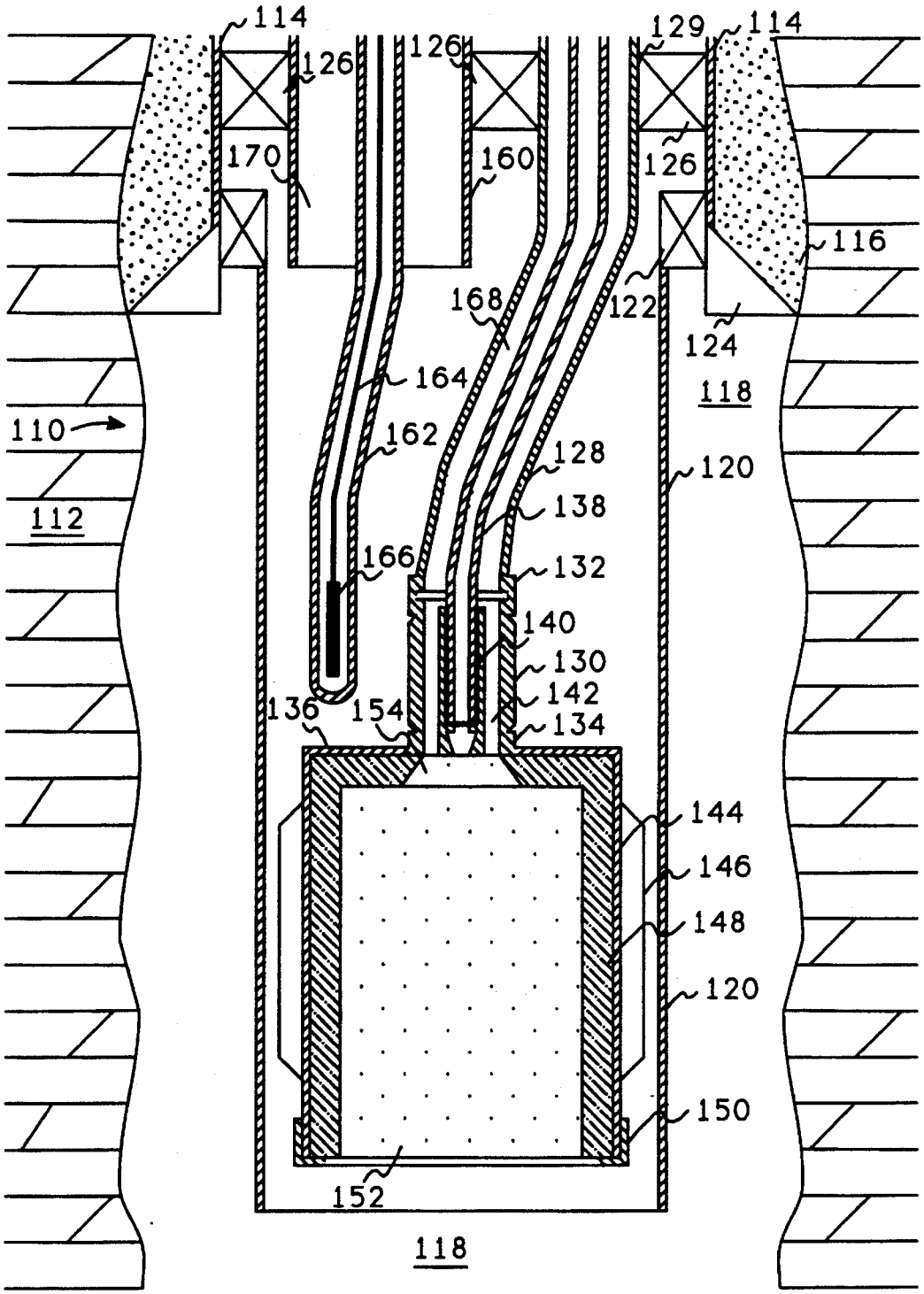
FIG. 1 is a perspective view illustrating one embodiment of the invention, partially sectioned to show a well extending into a subterranean injection zone.

Referring to FIG. 1, a well 110 penetrates a subterranean formation 112 and has an open or cased hole completion. A production casing 114 extends to the top of the formation and is cemented to the wall of the well by a cement bond 116. Adjacent the open hole interval 118, if required, is a casing liner 120, hung from the casing by casing liner hanger 122 at casing shoe 124. A dual bore packer 126 provides a seal between the open hole interval 118 and the cased portion of the well. The packer serves to prevent backflow of combustion products up the well.

A first tubing string 128 passes through a first bore 129 of the dual bore packer 126 and is connected to the upper end of burner nipple 130 by tubing collar 132. The lower end of burner nipple 130 is connected to a threaded top collar 134 of a burner assembly 136. A first coil tubing string 138 extends inside the first tubing string 128 from the wellhead through a coil tubing seal assembly 140 in the burner nipple 130 to the top collar of the burner assembly 136. Between the wall of the burner nipple 130 and the coil tubing seal assembly 140 are a plurality of passages 142.

The burner assembly 136 has an outer shroud 144. Preferably, the shroud is made from a high-temperature alloy. Centralizer vanes 146 ensure that the burner assembly is centralized with the casing liner 120, or formation 112, and also provide additional surface area for heat exchange. A removable refractory liner 148 floats within the shroud 144 and is held in place by a refractory retainer ring 150. Inside the liner a combustion chamber 152 is open on the bottom to the lower portion of the casing liner 120. An inlet 154 at the top of the assembly connects the passages 142 and the end of the coil tubing to top of the combustion chamber 152.

A second coil tubing string 162 is located inside the second tubing string 160. Within the second coil tubing string a wire 164 connects an instrument 166 with readout equipment at the surface. The instrument shown is a thermocouple, but other instruments could be placed within the second coil tubing string.

All of the equipment thus described is standard oilfield equipment except the burner nipple 130, the burner shroud 144, the refractory liner 148, and the retainer 150.

The present invention also comprises a method for maintaining pressure in and heating a subterranean formation. An oxidizing gas flows from the surface through a first annulus 168 between the first tubing string 128 and the first coil tubing string 138, through air passages 142 in the burner nipple 130, and into the top of the combustion chamber 1 52 of the burner assembly 136. Air is the preferred oxidizing gas, however, oxygen enriched air can also be used.

Fuel flows inside the first coil tubing string 138 from the surface to the burner assembly and into the top of the burner assembly via inlet 154. The fuel may be any hydrocarbon or mixture of hydrocarbons ranging from methane to diesel. As will be apparent to those skilled in the art, an appropriate nozzle is used when the fuel is a liquid. The preferred fuel is a mix of methane and other gases, since high pressure combustion provides an opportunity to fuel the burner with low BTU gas of low value. The fuel and the air are mixed in the upper portion of the combustion chamber 152. The concentric arrangement of the tubing improves mixing of the gases.

A pyrohoric fluid such as triethyl borine or sodium bromide, is mixed with the fuel at the surface. The pyrophoric fluid ignites when it contacts the air below the burner nozzle. Alternatively, a spark plug (not shown) may be used to ignite the mixture of fuel and oxidizing gas. Combustion occurs at a temperature of approximately 3700° F.

A coolant gas flows under pressure through a second annulus 170 between the second tubing string 160 and the second coil tubing string 162 from the surface to the open hole section of the well. As the coolant gas flows past the burner assembly 136, the assembly 136 and the centralizer vanes 146 function as a heat exchanger; the combustion products and the burner assembly 136 are cooled by the coolant gas while the coolant gas is heated. Higher temperatures increase the rate of corrosion of the downhole hardware. Thus, it is preferred to have at least six centralizer vanes 146 to promote heat exchange. However, the minimum length of the burner assembly limits the quantity of heat exchanged through the burner wall and centralizer vanes. Hot exhaust gas mixes with the coolant gas before they reach a common temperature. The heated coolant gas mixes with the exhaust gas exiting the bottom of the combustion chamber 152, and the gas mixture is injected into the open hole interval 118 of the formation.

The cooling gas can be any composition. Preferably, the coolant gas is comprised of produced gas and combustion products containing no more than 1 wt % $O_2$ to avoid increased corrosiveness of formation gas. Combustion cannot occur in formation due to dilution of already low $O_2$ concentration, however, an oxidation reaction may occur. A combustible mixture will only exist within the burner chamber. Preferably, the coolant gas contains essentially no $O_2$. However, a small amount of $O_2$ will react with the coolant gas in the well.

The gases are supplied at flow rates such that the coolant gas/combustion products mixture is injected into the formation at a pressure in excess of the formation pressure.

Preferably, the gas mixture is injected into a subterranean formation that is competent and has a high fluid conductivity. For example, the formation could have a network of open fractures. Preferably, the well has an open hole completion. However, the well could be cased if the cement used to secure the casing to the wellbore wall can withstand the high temperatures accompanying the combustion process of this invention. Gas injection can be continuous or intermittent.

The burner of the present invention may be used for enhancement of an in situ combustion process, especially in a fractured, hydrocarbon-bearing subterranean formation. In accordance with this alternative embodiment, the burner is positioned within well 110 adjacent the subterranean, hydrocarbon-bearing formation of interest and operated as described above until a temperature is reached, for example 500° F., which is sufficient for spontaneous reaction of hydrocarbons present in the formation. The term "spontaneous reaction" as utilized herein is inclusive of chemical oxidation or combustion. The coolant gas in this embodiment is also a combustion supporting gas, preferably air or oxygen enriched air. This coolant gas is superheated by operation of the burner to temperatures well above the temperature necessary to sustain the spontaneous reaction of hydrocarbons in the formation, for example about 600° F. to about 1000° F. Once hydrocarbons within the formation become reactive, the continuous injection of superheated, coolant gas into the formation supplies the reactant necessary to maintain such spontaneous reaction and to propagate the reaction front radially, outward from the well. By superheating the coolant gas within the well and adjacent the formation of interest, the coolant gas also serves to continuously maintain the temperature of the in situ combustion system within the formation so as to maintain the reactivity of hydrocarbons while propagating the in situ reaction front further away from the well. Because the coolant gas is superheated, substantially all hydrocarbons present in the formation, primarily the less valuable, residual heavy ends which are not normally produced, will be consumed as the front of an in situ combustion reaction passes through the formation. Given the relative absence of combustible hydrocarbons present in a portion of the formation after the combustion front has passed through, significant portions of the coolant gas being injected into the formation during an in situ combustion operation will be transported to the combustion front thereby effectively and efficiently enhancing the growth of the zone of reactivity from the well. In this manner, the use of the burner of the present invention to initiate and propagate an in situ combustion process in a subterranean formation, especially a fractured formation, efficiently enhances the process in a cost effective manner. It is preferred that the in situ combustion process set forth above be conducted in a well which is completed open hole, i.e. that is not cased. However, the well can be cased if the metallurgy of the casing is chosen to withstand extended periods of burner operation with oxygen enriched coolant gas.

Figure 2:
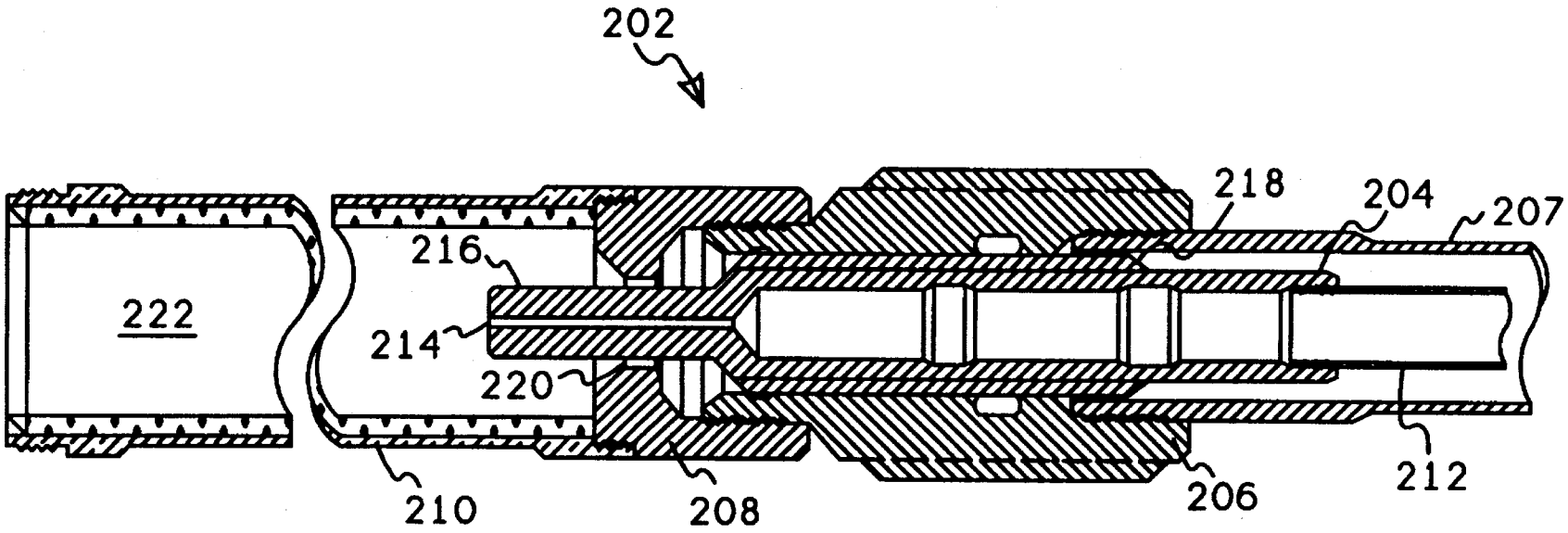
FIG. 2 shows a second embodiment of the invention, including the burner and supporting hardware.

FIG. 2 shows a second embodiment of the invention. Referring now to FIG. 2, a burner assembly 202 has a burner nozzle 204 contained within a burner nipple 206. The burner nipple 206 is attached to a first tubing string 207, which conducts oxidizing gas, typically air, from the surface of the well to the burner assembly 202. The burner nipple 206 is also connected to a burner shroud 208 which surrounds the downhole end of the burner nozzle 204. Attached to the burner shroud 208 is a burner shroud extension 210 which extends beyond the end of the burner nozzle 204 to contain the flame.

A coil tubing string 212 is concentrically arranged within the first tubing string 207 such that the coil tubing 212 is attached to the nozzle 204. The coil tubing 212 conducts fuel, typically methane gas, to the burner nozzle 204. The fuel passes through the nozzle 204 and exits through a small orifice 214 within an elongated nozzle end 216 attached to the nozzle body of the nozzle 204.

Centralizing vanes 218 attached to the burner nozzle 204 center the nozzle 204 within the burner nipple 206 and allow air contained within the first tubing string 207 to flow around the burner nozzle 204 and exit through an orifice 220 into the burner shroud extension 210. The orifice 220 is formed between the nozzle end 216 and an opening in the burner shroud 208 through which the nozzle end 216 is inserted. The orifice 220 is designed to be small in size to increase the velocity of the air exiting the burner shroud 208 into the combustion chamber 222. Also, the orifice 214 in the burner nozzle end 216 of the nozzle 204 is small to increase the velocity of the fuel as it exits the orifice 214. The combination of increased fuel velocity from the orifice 214 and increased air velocity through orifice 220 causes the flame front to be well down into the burner shroud extension 210 and prevents migration of the flame front back through either the nozzle 204 or back through the shroud 208. Positioning the flame front further down the shroud reduces the heat transfer across the shroud and centralizer vanes and the exhaust gas temperature is higher.

The burner nozzle end 216 is elongated to allow for expansion differences between the first tubing string 207 and the coil tubing 212. The elongation of burner nozzle end 216 allows the first tubing string to expand during operation while keeping the orifice 214 below the shroud 208, thus keeping the flame front below the shroud 208. The length of the nozzle end is determined by the difference in expansion that can occur between the first tubing string 207, including the burner nipple 206 and burner shroud 208, and the coil tubing string 212, including the nozzle 204 and burner nozzle end 216. This difference is determined by the material used to construct the devices, and the length of the two tubing strings.

Figure 3B:
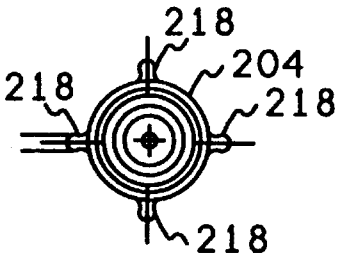
FIGS. 3A and 3B show side and end views of the burner of the second embodiment.
Figure 3A:
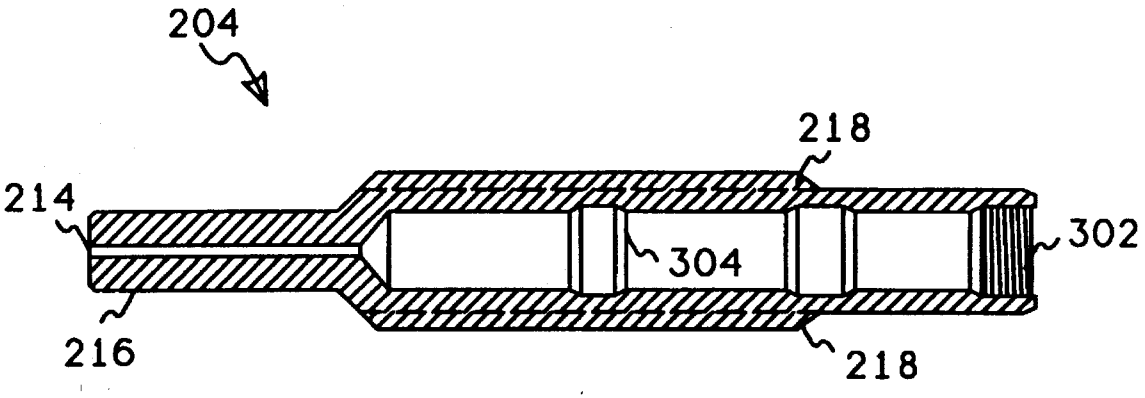

FIGS. 3A and 3B show a more detailed view of the burner nozzle 204 of FIG. 2. FIG. 3A shows a more detailed side view of the burner nozzle 204, and FIG. 3B shows an end view of the burner nozzle 204. Referring now to FIGS. 3A and 3B, the burner nozzle 204 is shown having the orifice 214 in the burner nozzle end 216 of the nozzle 204. Centralizing vanes 218 are shown on the sides of the nozzle 204 and are better shown in FIG. 3B. In the preferred embodiment, there are four centralizing vanes 218 oriented at 90° C. angles with respect to each other to support and center the nozzle 204 within the nipple 206 (FIG. 2) while allowing air to pass around the nozzle 204, through the burner shroud 208 (FIG. 2) and out through the orifice 220 (FIG. 2). The nozzle 204 contains threads 302 that mate with the coil tubing string 212 (FIG. 2) to conduct fuel through the nozzle 204 and out through the orifice 21 4. A landing nipple profile 304 is constructed to allow a wireline plug to be placed within the nozzle 204 so that the assembly can be inserted into a well without having to "kill" the well before the insertion. This has the added advantage of lower cost for inserting the burner into the well, as well as less damage to the formation containing the well.

Figure 4B:
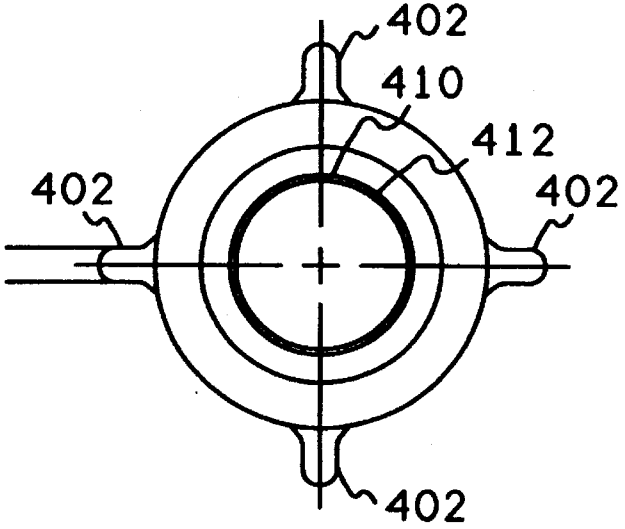
FIGS. 4A and 4B show side and end views of a burner nipple used to connect to the first tubing string and to contain the burner of the second embodiment.
Figure 4A:
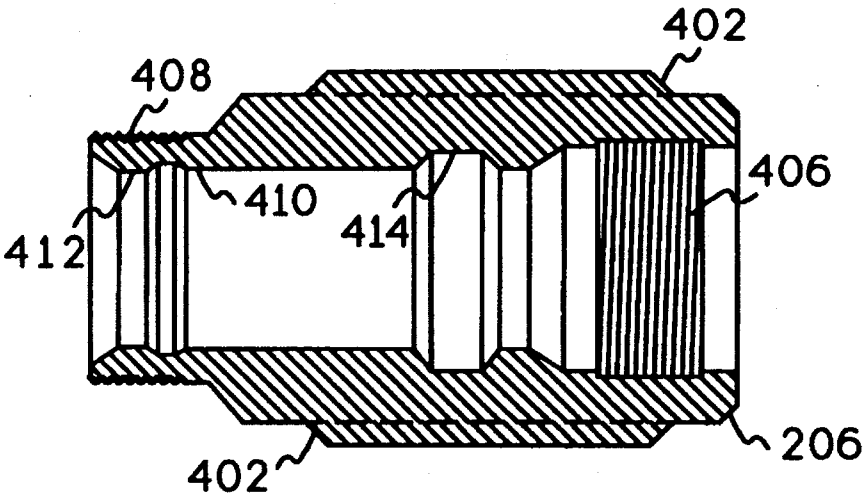

FIGS. 4A and 4B show a more detailed diagram of the burner nipple 206 of FIG. 2. FIG. 4A shows a more detailed side view, and FIG. 4B shows an end view of the burner nipple 206. Referring now to FIG. 4, the burner nipple 206 contains centralizing vanes 402 which operate in a manner similar to the centralizing vanes 218 on the nozzle 204. In the preferred embodiment, there are four centralizing vanes 402. The centralizing vanes 402 support and center the burner nipple 206 within a well casing liner (shown in FIG. 6 below) and permit the flow of coolant gas around the burner nipple 206 down past the shroud 208 and the shroud extension 210 to be mixed with the exhaust gases as they exit from the combustion chamber 222 (FIG. 2) of the shroud extension 210 (FIG. 2). Threads 406 allow the burner nipple 206 to mate with the tubing string 207 (FIG. 2), and threads 408 allow the burner nipple 206 to mate with the burner shroud 208 (FIG. 2).

The inside diameter 410 of the burner nipple 206 is large enough to accommodate the centralizing vanes 218 of the nozzle 204, however, the inside diameter 412 at the end of the burner nipple 206 is smaller than the inside diameter 410 and is not large enough to allow the vanes 21 8 of the burner nozzle 204 to pass. Therefore, the diameter 412 forms a no-go section which stops the passage of the burner nozzle 204 through the burner nipple 206. This allows the burner nozzle 204 to be passed down through the tubing string 207 and to be seated into the burner nipple 206 without passing beyond the burner nipple 206 and into the bottom of the well.

Figure 5:
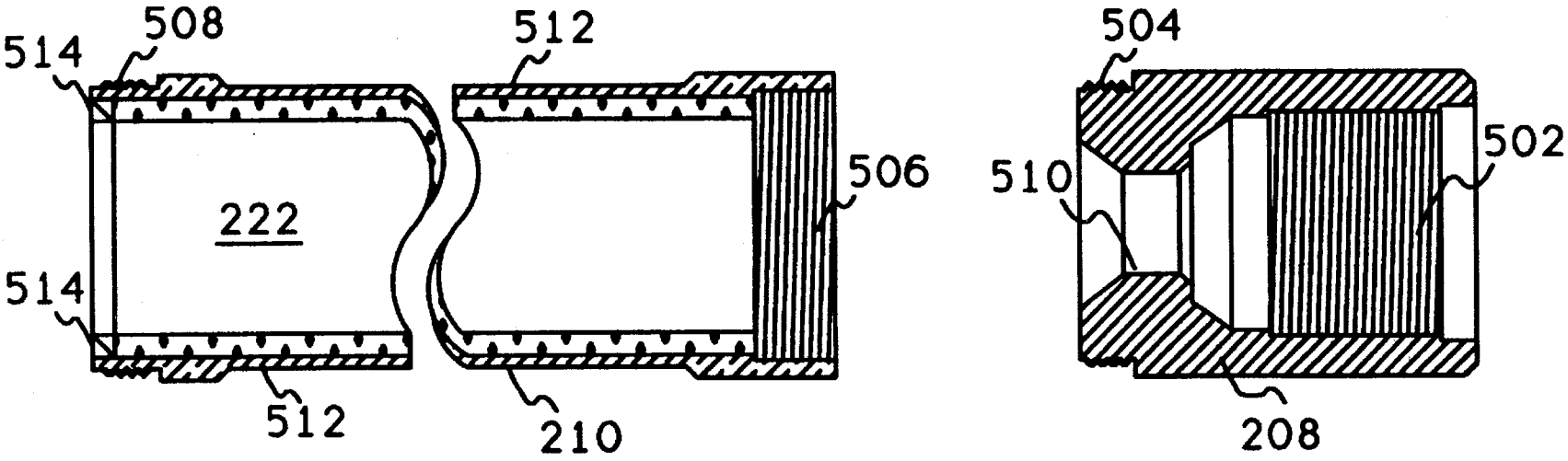
FIG. 5 shows a burner shroud and shroud extension of the second embodiment that is used to contain the combustion gases before they are mixed with the coolant gases.

FIG. 5 shows a more detailed drawing of the burner shroud 208 and burner shroud extension 210 of FIG. 2. Referring now to FIG. 5, the burner shroud 208 contains threads 502 that mate with threads 408 of the burner nipple (FIG. 4), to connect the shroud 208 and the nipple 206. Burner shroud 208 also contains threads 504 which mate with threads 506 of the burner shroud extension 210. The burner shroud extension 210 also contains threads 508 which would mate with threads 506 of a second burner shroud extension if such an extension is desired. In this manner, the burner shroud extension can be extended to any length desired to ensure complete combustion of the fuel and air mixture before allowing dilution of the combustion product with the residue gas.

As discussed above with respect to FIG. 2, the inside diameter 510 of the burner shroud 208 is larger than the outside diameter of the burner nozzle end 216 of the burner nozzle 204 (FIG. 2). The difference between these two diameters creates a concentrically arranged orifice with an area small enough to deliver a combustion air velocity high enough to prevent migration of the flame front back into the burner shroud or the burner nipple. In the preferred embodiment, the concentrically arranged orifice 220 has an area of approximately 0.018 square foot which creates a combustion air velocity of greater than 100 feet per second with a surface pressure of 650 pounds per square inch.

The burner shroud 210 is designed to contain the majority of the heat generated from the combustion reaction and is therefore constructed from a heat resistant alloy, for example INCONEL alloy 601. A removable refractory liner 512 floats within the shroud 210 and is held in place by a refractory retainer ring 514. The refractory liner is made of Greencast 97 or equivalent, and the retainer ring is made of a high temperature alloy. The combustion chamber 222 is open on the bottom of the shroud extension 210 to let combustion gasses out into the formation.

Figure 6A:
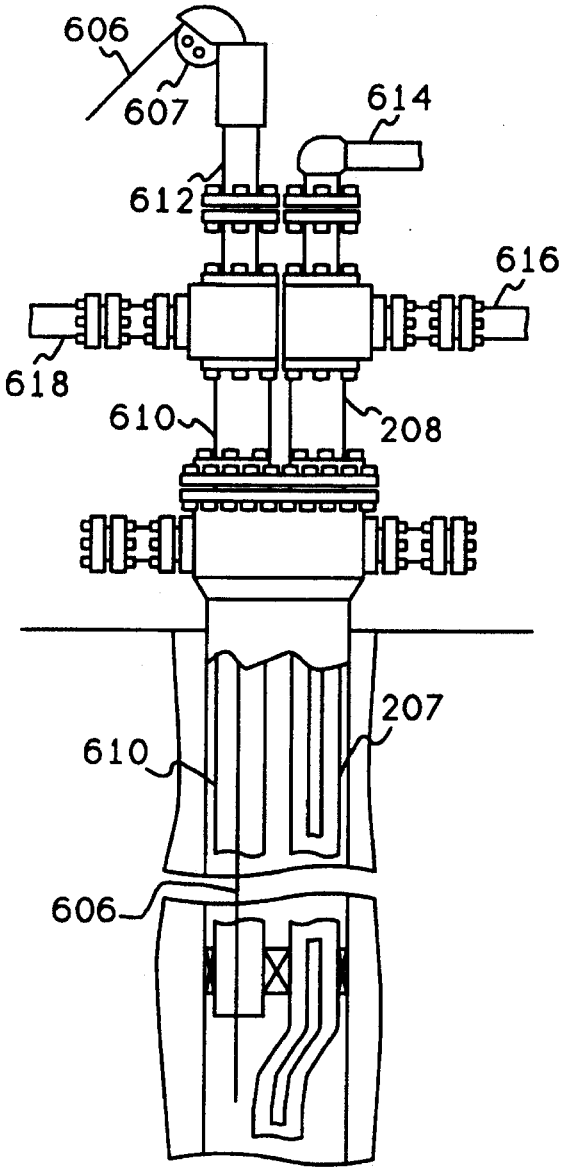
FIGS. 6A and 6B show an overview of how the burner of the second embodiment operates within a well.
Figure 6B:
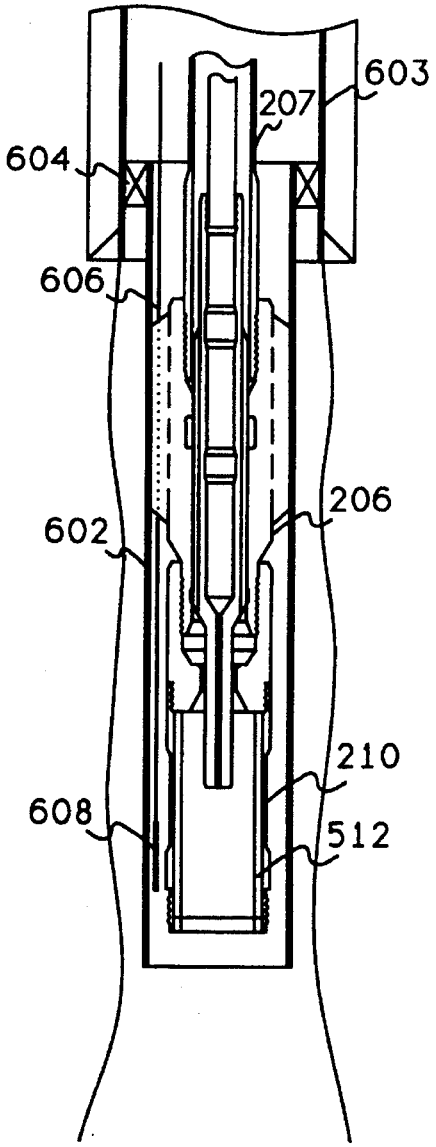

FIGS. 6A and 6B show a diagram of the burner inside a well. FIG. 6A shows the top portion of the well, and FIG. 6B shows the bottom portion of the well. Referring now to FIG. 6, the burner nozzle 204 is shown contained at the end of the first tubing string 207, and attached to the coil tubing string 212 which delivers fuel to the nozzle 204. The nozzle 204 is contained within the nipple 206 which is centered within a casing liner 602 by the centralizing vanes 402. The liner 602 is attached to the well casing 603 by means of a liner hanger 604.

Fuel enters the first tubing string 207 through connecting pipe 614 and flows down through coil string tubing 212 to the burner nozzle 204. Air enters the first tubing string 207 through connecting pipe 616, flowing around coil string tubing 212, around nozzle 204 and into the burner shroud extension 210.

A second tubing string 610 conveys coolant gas from the surface down to the burner. The coolant gas enters the second tubing string 610 through connecting pipe 618. The coolant gas flows through the second tubing string 610 and exits the second tubing string 610 above the liner hanger 604. The coolant gas then flows through casing liner 602 on the outside of the burner nipple 206, around the centralizing vanes 402, and on the outside of the burner shroud 210 to cool the burner shroud. The liner may not be required in certain formations. The coolant gas then mixes with the combusted exhaust gases exiting the burner shroud 210 and both flow into the formation.

Extending down through the coolant gas tubing string 610 is a wire 606 containing electrical connections for a thermocouple 608, or other device. The wire 606 extends out through the top of the well through a pulley 607 that allows the thermocouple or other device to be raised and lowered alongside the burner to measure temperatures at various points along side the burner.

Having thus described a presently preferred embodiment of the present invention, it will now be appreciated that the aspects of the invention have been fully achieved, and it will be understood by those skilled in the art that many changes in construction and widely differing embodiments and applications of the invention will suggest themselves without departing from the spirit and scope of the present invention. The disclosures and the description herein are intended to be illustrative and are not in any sense limiting of the invention, more preferably defined in scope by the following claims.

What is claimed is:

1. A burner for heating a hydrocarbonaceous formation or reservoir and for producing economical inert injectant, to thereby recover hydrocarbonaceous materials from said formation, said burner comprising:

a combustion chamber having an open lower end and having an upper end attached to an air supply conduit;

a nozzle, movably contained within said combustion chamber, and having a first end connected to a fuel supply conduit contained within said air supply conduit;

stopping means located within said combustion chamber for preventing said nozzle from being positioned beyond a predefined location toward said open lower end of said combustion chamber.

2. The burner of claim 1 wherein said nozzle further comprises a plurality of vanes symmetrically arranged about an outside surface of said nozzle, said vanes for centrally positioning said nozzle within said combustion chamber to allow air from said air supply conduit to flow around said nozzle, and wherein said vanes contact said stopping means to prevent said nozzle from being positioned beyond said predefined location.

3. The burner of claim 1 wherein said nozzle further comprises an elongated nozzle end opposite said first end, and wherein said combustion chamber further comprises a restriction below said stopping means and further wherein said elongated nozzle end protrudes through said restriction, wherein a length of said elongated nozzle end is sufficient to prevent said elongated nozzle end from moving above said restriction when a relative position of said nozzle and said combustion chamber changes from thermal expansion.

4. The burner of claim 3 wherein said restriction has a larger inside diameter than an outside diameter of said elongated nozzle end and wherein a cross-sectional area of an area between said restriction and said elongated nozzle end is smaller than a cross-sectional area of said air supply conduit, wherein air passing from said air supply conduit through said restriction is accelerated.

5. The burner of claim 4 wherein said elongated nozzle end of said nozzle further comprises a fuel exit orifice having a cross-sectional area smaller than a cross-sectional area of said fuel supply conduit, wherein fuel passing from said fuel supply conduit through said fuel exit orifice is accelerated.

6. The burner of claim 3 wherein said combustion chamber further comprises a liner attached to said combustion chamber, said liner extending from said restriction to said lower end of said combustion chamber.

7. The burner of claim 1 wherein combustion of said fuel is started by passing a pyrophoric fluid through said fuel supply conduit, and wherein said combustion begins when said pyrophoric fluid passes through said nozzle into air from said air supply conduit.

8. The burner of claim 1 wherein said combustion chamber further comprises a plurality of vanes symmetrically arranged about an outside surface of said combustion chamber, said vanes causing said combustion chamber to be centrally positioned within a casing liner to allow a gas to flow around said combustion chamber said gas being supplied by a gas conduit terminating above said combustion chamber.

9. The burner of claim 1 wherein said combustion chamber comprises a burner nipple having a first end attached to said air supply conduit, and a burner shroud attached to a second end of said burner nipple opposite said first end and wherein said stopping means is located within said burner nipple.

10. The burner of claim 1 wherein said combustion chamber contains a cross-sectional profile for accepting a wireline plug, wherein said combustion chamber can be placed in a well containing fluid by placing a wireline retrievable plug in said profile, and removing said plug after said combustion chamber is placed in said well.

11. The burner of claim 1 wherein said nozzle contains a cross-sectional profile for accepting a wireline plug, wherein said nozzle can be placed in a well containing fluid by placing a wireline retrievable plug in said profile, and removing said plug after said nozzle is placed in said well.

12. A burner for heating a hydrocarbonaceous formation or reservoir and for producing economical inert injectant, to thereby recover hydrocarbonaceous materials from said formation, said burner comprising:

a combustion chamber comprising a burner nipple having a first end attached to an air supply conduit, a burner shroud having a first end attached to a second end of said burner nipple opposite said first end of said burner nipple, and a burner shroud extension attached to a second end of said burner shroud, said burner shroud extension having an open lower end to allow combustion gasses to exit said combustion chamber;

a nozzle, movably contained within said combustion chamber, said nozzle having a nozzle body contained within said burner nipple, a first end connected to a fuel supply conduit contained within said air supply conduit, and having an elongated second end extending through said burner shroud;

stopping means located within said burner nipple for preventing said nozzle from being positioned beyond a predefined location toward said open lower end of said combustion chamber.

13. The burner of claim 12 wherein said nozzle further comprises a plurality of vanes symmetrically arranged about an outside surface of said nozzle, said vanes for centrally positioning said nozzle within said combustion chamber to allow air from said air supply conduit to flow around said nozzle, and wherein said vanes contact said stopping means to prevent said nozzle from being positioned beyond said predefined location.

14. The burner of claim 1 wherein said burner shroud further comprises a restriction and further wherein said elongated nozzle end protrudes through said restriction, wherein a length of said elongated nozzle end is sufficient to prevent said elongated nozzle end from moving above said restriction when a relative position of said nozzle and said burner shroud changes from thermal expansion.

15. The burner of claim 14 wherein said restriction has a larger inside diameter than an outside diameter of said elongated nozzle end and wherein a cross-sectional area of an area between said restriction and said elongated nozzle end is smaller than a cross-sectional area of said air supply conduit, wherein air passing from said air supply conduit through said restriction is accelerated.

16. The burner of claim 15 wherein said elongated nozzle end of said nozzle further comprises a fuel exit orifice having a cross-sectional area smaller than a cross-sectional area of said fuel supply conduit, wherein fuel passing from said fuel supply conduit through said fuel exit orifice is accelerated.

17. The burner of claim 14 wherein said burner shroud extension further comprises a liner attached to said burner shroud extension, said liner extending from said restriction to said lower end of said burner shroud extension.

18. The burner of claim 12 wherein combustion of said fuel is started by passing a pyrophoric fluid through said fuel supply conduit, and wherein said combustion begins when said pyrophoric fluid passes through said nozzle into air from said air supply conduit.

19. The burner of claim 12 wherein said combustion chamber further comprises a plurality of vanes symmetrically arranged about an outside surface of said combustion chamber, said vanes causing said combustion chamber to be centrally positioned within a casing liner to allow a gas to flow around said combustion chamber said gas being supplied by a gas conduit terminating above said combustion chamber.

20. The burner of claim 12 wherein said combustion chamber contains a cross-sectional profile for accepting a wireline plug, wherein said combustion chamber can be placed in a well containing fluid by placing a wireline retrievable plug in said profile, and removing said plug after said combustion chamber is placed in said well.

21. The burner of claim 12 wherein said nozzle contains a cross-sectional profile for accepting a wireline plug, wherein said nozzle can be placed in a well containing fluid by placing a wireline retrievable plug in said profile, and removing said plug after said nozzle is placed in said well.

22. A method for in situ combustion of hydrocarbons present in a subterranean formation which is penetrated by a well in fluid communication therewith, the method comprising:

raising the temperature of the formation adjacent the well to an ignition temperature which is sufficient to ignite hydrocarbons present in the formation;

superheating an oxygen-containing gas within the well to a temperature which is greater than said ignition temperature; and injecting said superheated oxygen-containing gas into the formation to sustain and propagate the combustion of hydrocarbons present in the formation.

23. The method of claim 22 wherein said subterranean formation is fractured.

24. The method of claim 22 wherein said formation adjacent the well is heated to said ignition temperature by means of a burner positioned within the well.

25. The method of claim 24 said oxygen-containing gas is superheated while serving as a coolant gas for said burner.

26. The method of claim 22 wherein said oxygen-containing gas is air or oxygen enriched air.

27. The method of claim 22 wherein said oxygen-containing gas is superheated to between about 600° F. and about 1000° F.

* * * * *